US008136555B1

(12) United States Patent
Chang et al.

(10) Patent No.: US 8,136,555 B1
(45) Date of Patent: Mar. 20, 2012

(54) ABRASION RESISTANT PRODUCT AND METHOD OF FABRICATING AN ABRASION RESISTANT PRODUCT

(75) Inventors: Jae Chul Chang, Chicago, IL (US); Eun Seong Chang, Chicago, IL (US); Eun Ji Kim, Chicago, IL (US)

(73) Assignee: Ribbon Webbing Corp., Chicago, IL (US)

( * ) Notice: Subject to any disclaimer, the term of this patent is extended or adjusted under 35 U.S.C. 154(b) by 0 days.

(21) Appl. No.: 13/069,822

(22) Filed: Mar. 23, 2011

(51) Int. Cl.

| | |
|---|---|
| ***D03D 1/00*** | (2006.01) |
| ***D03D 3/00*** | (2006.01) |
| *D03D 23/00* | (2006.01) |
| *H02G 1/08* | (2006.01) |

(52) U.S. Cl. ..... 139/384 R; 139/383 R; 139/387 R; 139/426 R

(58) Field of Classification Search ..... 174/34, 174/36, 19; 139/383 R, 384 R, 387 R, 404–406, 139/426 R See application file for complete search history.

(56) References Cited

U.S. PATENT DOCUMENTS

| | | | | |
|---|---|---|---|---|
| 1,447,100 | A * | 2/1923 | Pardoe | 188/259 |
| 3,516,896 | A * | 6/1970 | Laurent | 442/184 |
| 3,926,227 | A | 12/1975 | Takada et al. | |
| 4,421,352 | A | 12/1983 | Raue et al. | |
| 4,800,929 | A | 1/1989 | Watanabe | |
| 4,955,182 | A * | 9/1990 | Newman | 54/79.2 |
| 5,220,705 | A * | 6/1993 | Bushey | 16/42 R |
| 5,244,718 | A * | 9/1993 | Taylor et al. | 442/208 |
| 5,436,044 | A | 7/1995 | Pinkos | |
| 6,283,167 | B1 * | 9/2001 | Chang et al. | 139/383 R |
| 6,383,959 | B1 * | 5/2002 | Morris et al. | 442/218 |
| 6,607,995 | B1 * | 8/2003 | Takeuchi et al. | 442/216 |
| 7,188,642 | B2 * | 3/2007 | James et al. | 139/384 R |
| 7,346,935 | B1 * | 3/2008 | Patterson | 2/239 |
| 2002/0117121 | A1 * | 8/2002 | Sporn | 119/856 |
| 2005/0185902 | A1 * | 8/2005 | James et al. | 385/100 |
| 2005/0282023 | A1 * | 12/2005 | Comeaux et al. | 428/447 |
| 2007/0161490 | A1 * | 7/2007 | Srivastava | 493/464 |
| 2008/0121305 | A1 * | 5/2008 | Metzger | 139/421 |
| 2008/0156044 | A1 * | 7/2008 | Patterson | 66/178 R |
| 2008/0264512 | A1 * | 10/2008 | Metzger | 139/420 R |
| 2011/0278906 | A1 * | 11/2011 | Shimazaki et al. | 297/475 |

FOREIGN PATENT DOCUMENTS

| | | |
|---|---|---|
| WO | WO-92/03603 A1 | 3/1992 |

* cited by examiner

*Primary Examiner* — Bobby Muromoto, Jr.

(74) *Attorney, Agent, or Firm* — Marshall, Gerstein & Borun LLP

(57) ABSTRACT

An abrasion resistant woven product includes a plurality of weft yarns interwoven with a plurality of warp yarns. The plurality of weft and warp yarns are interwoven perpendicular to each other to define a webbing with opposite top and bottom surfaces. Each of the top and bottom surfaces includes a plurality of rows of buttons spaced apart by at least one depression such that the plurality of buttons of each row are interleaved with a plurality of buttons of an adjacent row.

19 Claims, 8 Drawing Sheets

PATTERN ANDHARNESS DIAGRAM

| | | | | | | | | | | | | |
|---|---|---|---|---|---|---|---|---|---|---|---|---|
| 1 | | | | | 4 | | | | | | 4 | |
| 2 | | | | 3 | | 3 | | | | 3 | | 3 |
| 3 | | 2 | | | | | | 2 | | | | |
| 4 | 1 | | 1 | | | | 1 | | 1 | | | |

REPEAT

*FIG. 4*

| CHAIN ROW | | | | | | | | |
|---|---|---|---|---|---|---|---|---|
| 1 | • | • | X | X | • | • | X | X |
| 2 | • | X | X | • | • | X | X | • |
| 3 | X | X | • | • | X | X | • | • |
| 4 | X | • | • | X | X | • | • | X |
| | 1 | 2 | 3 | 4 | 5 | 6 | 7 | 8 |

CHAIN OR CAM

*FIG. 5*

PATTERN AND HARNESS DIAGRAM

| | | | | | | | | | | | | | |
|---|---|---|---|---|---|---|---|---|---|---|---|---|---|
| 8 | | | | | | | | | | 8 | | | 10 |
| 7 | | | | | | | | | 7 | | 7 | | 10 |
| 6 | | | | | 6 | | | | | | | 9 | |
| 5 | | | | 5 | | 5 | | | | | | 9 | |
| 4 | | | | | | | | 4 | | | | | 10 |
| 3 | | | | | | | 3 | | 3 | | | | 10 |
| 2 | | 2 | | | | | | | | | | 9 | |
| 1 | 1 | | 1 | | | | | | | | | 9 | |

REPEAT

| CHAIN ROW | 1 | 2 | 3 | 4 | 5 | 6 | 7 | 8 | 9 | 10 |
|---|---|---|---|---|---|---|---|---|---|---|
| 1 | • | X | • | X | • | • | • | • | • | X |
| 2 | • | • | • | • | X | • | X | • | • | X |
| 3 | • | X | • | • | • | • | • | X | X | • |
| 4 | • | • | X | • | X | • | • | • | X | • |
| 5 | • | • | • | • | • | X | • | X | • | X |
| 6 | X | • | X | • | • | • | • | • | • | X |
| 7 | • | • | • | X | • | X | • | • | X | • |
| 8 | X | • | • | • | • | • | X | • | X | • |

CHAIN OR CAM

ABRASION RESISTANT PRODUCT AND METHOD OF FABRICATING AN ABRASION RESISTANT PRODUCT

FIELD OF THE DISCLOSURE

The present disclosure is directed to woven product such as woven webbing and, more particularly, to woven product having abrasion resistant properties.

BACKGROUND

Many conventional woven products are made using a multilayer construction that may or may not include a core material, which is encased by a separate fabric shell. Typically, the fabric shell is selected to provide a desired outward appearance such as a texture and/or an aesthetically appealing pattern. Additionally, the fabric shell may be selected to provide desired surface durability characteristics such as abrasion resistance, tear resistance, color fastness, etc. Any core material, on the other hand, is typically selected to provide a desired shape, body, stiffness, weight, etc. to the fabric shell to suit a particular application. Fabrication of the above-described fabric shell generally corresponds to a conventional, well known, weave pattern such as, for example, a 1-2-3-4-3-2-1 pattern. Conventional product fabricated with a known 1-2-3-4-3-2-1 pattern is often implemented to fabricate vehicle seat belts, fall restraint webbing, back pack webbing, etc. While these conventional products perform generally satisfactorily, the webbing industry can benefit from products having improved abrasion resistance, for example, to increase the functional integrity of the product.

SUMMARY

One aspect of the present disclosure provides a woven product including a first plurality of parallel weft yarns and a first plurality of warp yarns. The first plurality of warp yarns are interwoven perpendicular to the first plurality of weft yarns to define a first webbing with opposite top and bottom surfaces. Each of the top and bottom surfaces includes a plurality of rows of buttons spaced apart by a plurality of depressions. The plurality of buttons of each row are interleaved with a plurality of buttons of an adjacent row.

In some aspects, each button comprises a pair of adjacent trailing petals and a leading petal disposed between and extending outward from the trailing petals.

In some aspects, the first plurality of weft yarns comprises a plurality of weft yarn bundles, and the first plurality of warp yarns comprises a plurality of warp yarn bundles. Each weft yarn bundle comprises first, second, third, and fourth parallel and adjacent weft yarns. The first plurality of warp yarns comprises a plurality of upper warp yarn bundles and a plurality of lower warp yarn bundles disposed perpendicular to and interwoven with the plurality of weft yarn bundles. Each warp yarn bundle comprises a pair of parallel trailing yarns and a leading yarn disposed between and parallel to the pair of trailing yarns. The leading yarn in each upper warp yarn bundle extending above the first and fourth weft yarns and below the second and third weft yarns in each weft yarn bundle. The pair of trailing yarns in each upper warp yarn bundle extending above the first and second weft yarns and below the third and fourth weft yarns of each weft yarn bundle. The leading yarn in each lower warp yarn bundle extending below the first and fourth weft yarns and above the second and third weft yarns in each weft yarn bundle. The pair of trailing yarns in each lower warp yarn bundle extending below the first and second weft yarns and above the third and fourth weft yarns of each weft yarn bundle.

In some aspects, the woven product can further include a second plurality of parallel weft yarns and a second plurality of warp yarns. The second plurality of parallel weft yarns are disposed below the first plurality of weft yarns. The second plurality of warp yarns are interwoven perpendicular to the second plurality of weft yarns to define a second webbing disposed below and parallel to the first webbing. The second webbing has opposite top and bottom surfaces, and each of the top and bottom surfaces includes a plurality of rows of yarn buttons. Each row includes a plurality of buttons spaced apart by a plurality of depressions, wherein the plurality of buttons of each row interleaved with a plurality of buttons of an adjacent row.

In some aspects, the woven product further includes a plurality of binder yarns disposed parallel to each other and perpendicular to the first and second pluralities of weft yarns. The binder yarns woven into the first and second webbings and securing the first and second pluralities of weft yarns together.

In some aspects, a central section of the first and second webbings are not secured together, thereby defining at least one pocket extending along a length of the product.

Another aspect of the present disclosure provides a woven product including a first plurality of weft yarns and a first plurality of warp yarns interwoven with the first plurality of weft yarns to define a first webbing. The first plurality of weft yarns comprising a plurality of weft yarn bundles, each weft yarn bundle comprising first, second, third, and fourth parallel and adjacent weft yarns. The first plurality of warp yarns comprising a plurality of upper warp yarn bundles and a plurality of lower warp yarn bundles disposed perpendicular to and interwoven with the plurality of weft yarn bundles. Each warp yarn bundle comprising a pair of parallel trailing yarns and a leading yarn disposed between and parallel to the pair of trailing yarns. The leading yarn in each upper warp yarn bundle extending above the first and fourth weft yarns and below the second and third weft yarns in each weft yarn bundle. The pair of trailing yarns in each upper warp yarn bundle extending above the first and second weft yarns and below the third and fourth weft yarns of each weft yarn bundle. The leading yarn in each lower warp yarn bundle extending below the first and fourth weft yarns and above the second and third weft yarns in each weft yarn bundle. The pair of trailing yarns in each lower warp yarn bundle extending below the first and second weft yarns and above the third and fourth weft yarns of each weft yarn bundle.

In some aspects, the first webbing includes opposite top and bottom surfaces. Each of the top and bottom surfaces comprising a plurality of rows of buttons spaced apart by a plurality of depressions. The plurality of buttons of each row interleaved with a plurality of buttons of an adjacent row.

In some aspects, each button comprises a pair of adjacent trailing petals and a leading petal disposed between and extending outward from the trailing petals.

In some aspects, the woven product further includes a second plurality of weft yarns and a second plurality of warp yarns interwoven with the second plurality of weft yarns to define a second webbing disposed parallel to the first webbing. The second plurality of weft yarns comprising a plurality of weft yarn bundles, each weft yarn bundle comprising first, second, third, and fourth parallel and adjacent weft yarns. The second plurality of warp yarns comprising a plurality of upper warp yarn bundles and a plurality of lower warp yarn bundles disposed perpendicular to and interwoven with the plurality of weft yarn bundles. Each warp yarn bundle comprising a pair of parallel trailing yarns and a leading yarn disposed between and parallel to the pair of trailing yarns. The leading yarn in each upper warp yarn bundle extending above the first and fourth weft yarns and below the second and third weft yarns in each weft yarn bundle. The pair of trailing yarns in each upper warp yarn bundle extending above the first and second weft yarns and below the third and fourth weft yarns of each weft yarn bundle. The leading yarn in each lower warp yarn bundle extending below the first and fourth weft yarns and above the second and third weft yarns in each weft yarn bundle. The pair of trailing yarns in each lower warp yarn bundle extending below the first and second weft yarns and above the third and fourth weft yarns of each weft yarn bundle.

In some aspects, the first webbing and the second webbing each includes opposite top and bottom surfaces. Each of the top and bottom surfaces comprising a plurality of rows of buttons spaced apart by a plurality of depressions. The plurality of buttons of each row interleaved with a plurality of buttons of an adjacent row.

In some aspects, the woven product further includes a plurality of binder yarns disposed parallel to each other and perpendicular to the first and second pluralities of weft yarns. The binder yarns woven into the first and second webbings and securing the first and second pluralities of weft yarns together.

In some aspects, the woven product further includes at least one pocket extending along a length of the product between the first and second webbings.

Another aspect of the present disclosure provides a method of weaving a product including a first plurality of weft yarns and a first plurality of warp yarns interwoven with the first plurality of weft yarns to define a first webbing. The first plurality of weft yarns include a plurality of weft yarn bundles, wherein each weft yarn bundle includes first, second, third, and fourth parallel weft yarns. The first plurality of warp yarns including a plurality of upper and lower warp yarn bundles. Each warp yarn bundle includes a pair of trailing yarns and a leading yarn disposed between the trailing yarns. The method includes manipulating the first plurality of weft yarns relative to the first plurality of warp yarns to define the first webbing, wherein manipulating the first plurality of weft yarns includes the following: (A) weaving the first weft yarn of each weft yarn bundle (i) below the leading yarn of each upper warp yarn bundle, (ii) below the pair of trailing yarns of each upper warp yarn bundle, (iii) above the leading yarn of each lower warp yarn bundle, and (iv) above the pair of trailing yarns of each lower warp yarn bundle; (B) weaving the second weft yarn of each weft yarn bundle (i) below the leading yarn of each lower warp yarn bundle, (ii) below the pair of trailing yarns of each upper warp yarn bundle, (iii) above the leading yarn of each upper warp yarn bundle, and (iv) above the pair of trailing yarns of each lower warp yarn bundle; (C) weaving the third weft yarn of each weft yarn bundle (i) below the leading yarn of each lower warp yarn bundle, (ii) below the pair of trailing yarns of each lower warp yarn bundle, (iii) above the leading yarn of each upper warp yarn bundle, and (iv) above the pair of trailing yarns of each upper warp yarn bundle; and (D) weaving the fourth weft yarn of each weft yarn bundle (i) below the leading yarn of each upper warp yarn bundle, (ii) below the pair of trailing yarns of each lower warp yarn bundle, (iii) above the leading yarn of each lower warp yarn bundle, and (iv) above the pair of trailing yarns of each upper warp yarn bundle.

In some aspects, the product further includes a second plurality of weft yarns and a second plurality of warp yarns interwoven with the second plurality of weft yarns to define a second webbing that is disposed parallel to the first webbing, the second plurality of weft yarns including a plurality of weft yarn bundles, wherein each weft yarn bundle includes first, second, third, and fourth parallel weft yarns, the second plurality of warp yarns including a plurality of upper and lower warp yarn bundles, each warp yarn bundle including a pair of trailing yarns and a leading yarn disposed between the trailing yarns, and the method further includes manipulating the second plurality of weft yarns perpendicular to the second plurality of warp yarns to define the second webbing, wherein manipulating the second plurality of weft yarns includes (A) weaving the first weft yarn of each weft yarn bundle (i) below the leading yarn of each upper warp yarn bundle, (ii) below the pair of trailing yarns of each upper warp yarn bundle, (iii) above the leading yarn of each lower warp yarn bundle, and (iv) above the pair of trailing yarns of each lower warp yarn bundle; (B) weaving the second weft yarn of each weft yarn bundle (i) below the leading yarn of each lower warp yarn bundle, (ii) below the pair of trailing yarns of each upper warp yarn bundle, (iii) above the leading yarn of each upper warp yarn bundle, and (iv) above the pair of trailing yarns of each lower warp yarn bundle; (C) weaving the third weft yarn of each weft yarn bundle (i) below the leading yarn of each lower warp yarn bundle, (ii) below the pair of trailing yarns of each lower warp yarn bundle, (iii) above the leading yarn of each upper warp yarn bundle, and (iv) above the pair of trailing yarns of each upper warp yarn bundle; and (D) weaving the fourth weft yarn of each weft yarn bundle (i) below the leading yarn of each upper warp yarn bundle, (ii) below the pair of trailing yarns of each lower warp yarn bundle, (iii) above the leading yarn of each lower warp yarn bundle, and (iv) above the pair of trailing yarns of each upper warp yarn bundle.

In some aspects, the method further includes weaving a plurality of binder yarns between the first and second pluralities of weft yarns to secure the first and second webbings together.

Another aspect of the present disclosure provides method of fabricating a woven product having a plurality of weft yarns interwoven with a plurality of warp yarns, wherein the method includes operating a loom having a plurality of harnesses and a plurality of gears set up according to a chain draft diagram having first through fourth rows and first through eighth columns. The first row includes down picks in the first, second, fifth, and sixth columns, and up picks in the third, fourth, seventh, and eighth columns. The second row includes down picks in the first, fourth, fifth, and eighth columns, and up picks in the second, third, sixth, and seventh columns. The third row includes down picks in the third, fourth, seventh, and eighth columns, and up picks in the first, second, fifth, and sixth columns. The fourth row includes down picks in the second, third, sixth, and seventh columns, and up picks in the first, fourth, fifth, and eighth columns.

Still another aspect of the present disclosure provides a method of fabricating a woven product having a plurality of weft yarns interwoven with a plurality of warp yarns, wherein the method includes operating a loom having a plurality of harnesses and a plurality of gears set up according to a chain draft diagram having first through eighth rows and first through tenth columns. The first row includes down picks in the first, third, and fifth through ninth columns, and up pick in the second, fourth, and tenth columns. The second row includes down picks in the first through fourth, sixth, eighth, and ninth columns, and up picks in the fifth, seventh, and tenth columns. The third row includes down picks in the first, third through seventh, and tenth columns, and up picks in the second, eighth, and ninth columns. The fourth row includes down picks in the first, second, fourth, sixth through eighth, and tenth columns, and up picks in the third, fifth, and ninth columns. The fifth row includes down picks in the first through fifth, seventh, and ninth columns, and up picks in the sixth, eighth, and tenth columns. The sixth row includes down picks in the second, and fourth through ninth columns, and up picks in the first, third, and tenth columns. The seventh row includes down picks in the first through third, fifth, seventh, and eighth columns, and up picks in the fourth, sixth, and ninth columns. Finally, the eighth row includes down picks in the second through sixth, eighth, and tenth columns, and up picks in the first, seventh, and ninth columns.

Yet another aspect of the present disclosure provides a method of fabricating a woven product having a plurality of weft yarns interwoven with a plurality of warp yarns, wherein the method includes operating a loom having a plurality of harnesses and a plurality of gears set up according to a chain draft diagram having first eighth fourth rows and first through eighth columns. The first row includes down picks in the first, third, and fifth through eighth columns, and up pick in the second and fourth columns. The second row includes down picks in the first through fourth, sixth, and eighth columns, and up picks in the fifth and seventh columns. The third row includes down picks in the first and third through seventh columns, and up picks in the second and eighth columns. The fourth row includes down picks in the first, second, fourth, and sixth through eighth columns, and up picks in the third and fifth columns. The fifth row includes down picks in the first through fifth and seventh columns, and up picks in the sixth and eighth columns. The sixth row includes down picks in the second, and fourth through eighth columns, and up picks in the first and third columns. The seventh row includes down picks in the first through third, fifth, seventh, and eighth columns, and up picks in the fourth and sixth columns. Finally, the eighth row includes down picks in the second through sixth and eighth columns, and up picks in the first and seventh columns.

BRIEF DESCRIPTION OF THE DRAWINGS

FIG. 4 is a pattern and harness diagram representative of the woven product of FIGS. 1-3;

FIG. 5 is a chain draft diagram for fabricating the woven product of FIGS. 1-3A;

DESCRIPTION

The present disclosure is directed to a woven product such as fabric webbing, for example, having, amongst other things, increased abrasion resistance and/or an increased tolerance for frictional interaction with abrasive materials. To help achieve this increased abrasion resistance, the webbing is fabricated by weaving a plurality of weft and warp yarns in a particular manner such that the top and bottom surfaces of the webbing can be defined as including a plurality of rows of buttons, wherein the buttons of each row are spaced apart by a plurality of depressions, and wherein each row of buttons is interleaved with adjacent rows of buttons. So configured, the top and bottom surfaces of the product (e.g., webbing) of the present disclosure define reduced surface areas such as to minimize the friction generated with any surface sliding along the top or bottom surface of the product. Moreover, because the buttons in each row are separated by depressions and are interleaved between buttons of adjacent rows, the top and bottom surfaces are designed to minimize the friction generated between the product and any abrasive surface such as, for example, a seat belt buckle, a vehicle frame, a rock climbing wall, etc., that the product may slide over. As such, it should be appreciated that the product of the present disclosure has a wide range of useful applications including, but not limited to, bulk bags, belts (e.g., fashion, military, safety, sports, law enforcement, etc.), emergency rescue (e.g., fire, lineman, fall protection, first responders, etc.), back pack webbing, pet collars, pet leashes, leads, luggage straps, safety equipment and supplies, cargo/freight tie-downs, tow straps, lifting slings, aircraft and aerospace applications, mountaineering, rock climbing, ice climbing, automotive and recreational vehicle applications, child safety, harvesters and mowers, rifle slings, shoulder straps, boating and hunting applications, harnesses and halters, aquatic life preservers and other floatation devices, parachuting, surgical or other medical facility applications, other outdoor and recreational applications, burial or mortuary applications, etc.

Figure 1:
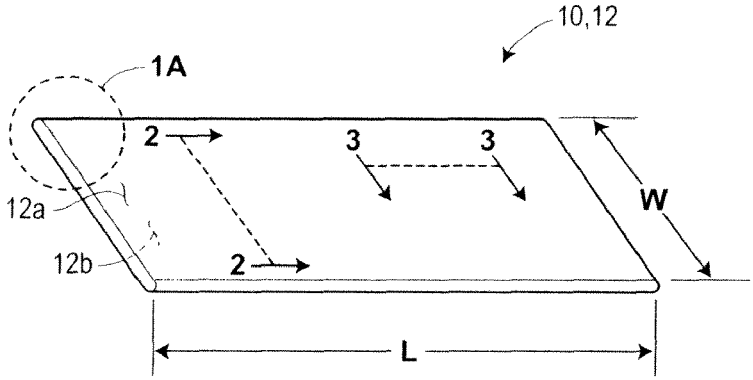
FIG. 1 is a perspective view of one example of a product constructed in accordance with the principles of the present invention.

With reference now to the drawings, various working examples of the product of the present disclosure will now be described. FIG. 1 depicts a perspective view of one example of a woven product 10, which includes a woven fabric webbing 12. The webbing 12 includes a width W and a length L. Moreover, the webbing 12 includes opposite first and second generally two-dimensional surfaces 12*a*, 12*b*. The first surface 12*a* may be referred to as a top surface 12*a*, relative to the orientation of FIG. 1, and the second surface 12*b* may be referred to as a bottom surface 12*b*, relative to the orientation of FIG. 1.

Figure 1A:
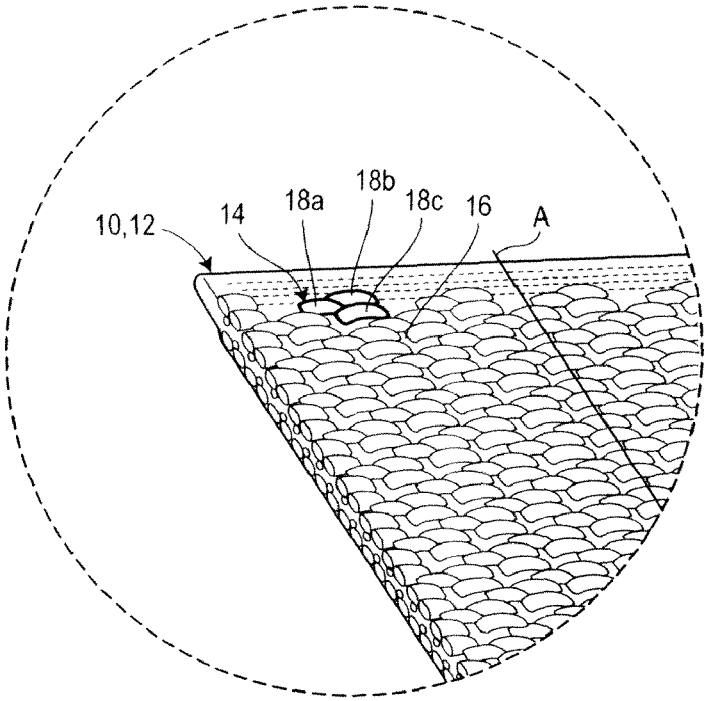
FIG. 1A is a detail view of a top surface of the product depicted in FIG. 1, taken from circle 1A.

As shown in greater detail in FIG. 1A, the top surface 12*a* of the webbing 12 can be described as defining a plurality of rows of buttons 14 (one of which is highlighted in bold in FIG.

1A) extending in the width W direction of the webbing 12, wherein the buttons 14 of any given row are separated by one or more depressions 16. While FIG. 1A illustrates the top surface 12*a* of the webbing 12, the bottom surface 12*b* can be configured generally identically such that both the top and bottom surfaces 12*a*, 12*b* include a plurality of buttons 14 arranged in rows and separated by one or more depressions 16. Moreover, as illustrated, each row of buttons 14 can be described as being interleaved with adjacent rows of buttons 14. Said another way, each button 14 within any given row is at least partly disposed between a pair of buttons 14 in an immediately adjacent row. So configured, each row of buttons 14 meshes with its immediately adjacent rows in a manner similar to that which teeth on a gear mesh with teeth on an adjacent gear, for example. So configured, at any give location along the length L of the webbing 12, a straight line A disposed across the width W of the webbing 12, as illustrated in FIG. 1A, contacts the buttons 14 of the webbing 12 and does not contact the webbing 12 where the depressions 16 are located. So configured, there is a reduced surface area of contact between an object having at least a line of contact with the webbing 12, for example, as represented by line A in FIG. 1A, and the surface of the webbing 12. This reduced surface area reduces the contact area of the webbing 12 and, as such, can reduce friction and abrasion.

Figure 2:
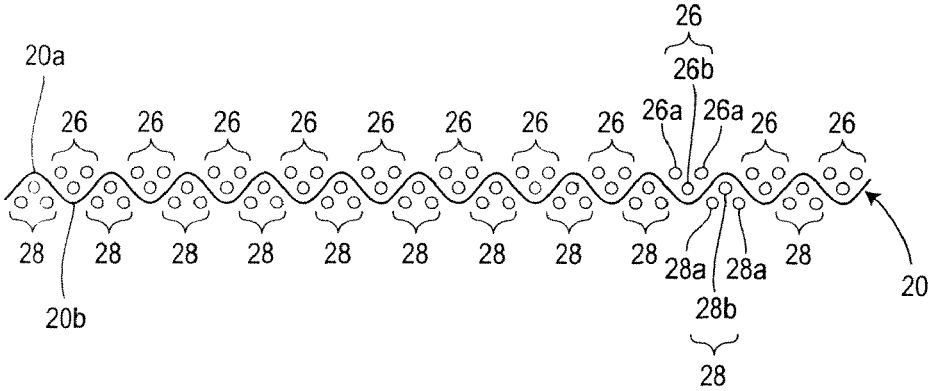
FIG. 2 is a cross-section of the product of FIG. 1, taken from line 2-2.
Figure 3:
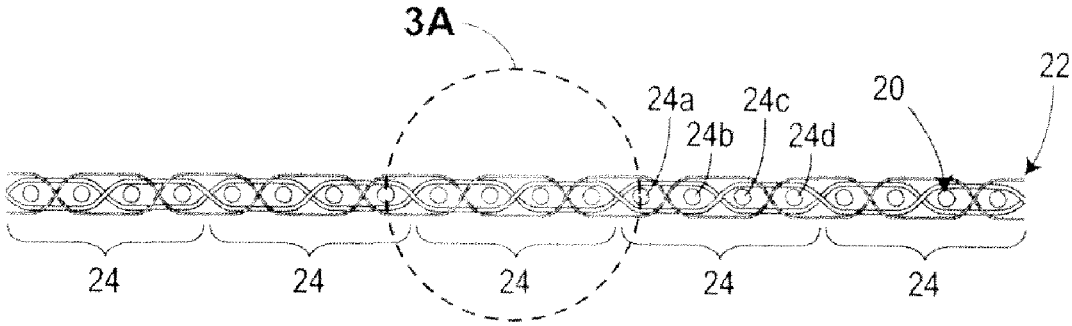
FIG. 3 is a cross-section of the product of FIG. 2, taken from line 3-3.

With continued reference to FIG. 1A, each of the buttons 14 defined by the top and bottom surfaces 12*a*, 12*b* of the webbing 12 includes three petals 18*a*, 18*b*, 18*c*, defined by yarns. For example, as depicted in FIGS. 2 and 3, the webbing 12 of the present disclosure includes a plurality of weft yarns 20 interwoven with a plurality of warp yarns 22. The plurality of weft yarns 20 extend along the width W of the webbing 12, and the plurality of warp yarns 22 extend perpendicular to the weft yarns 20 along the length L of the webbing 12. Referring now to FIG. 3, and for the sake of description, the plurality of weft yarns 20 includes a plurality of weft yarn bundles 24. Each weft yarn bundle 24 includes first, second, third, and fourth parallel and adjacent weft yarns 24*a*, 24*b*, 24*c*, 24*d*.

Referring to FIG. 2, and for the sake of description, the plurality of warp yarns 22 includes a plurality of upper warp yarn bundles 26 and a plurality of lower warp yarn bundles 28. The upper and lower warp yarn bundles 26, 28 are disposed perpendicular to and interwoven with the plurality of weft yarn bundles 24 such that the weft yarns 20 occupy a configuration that can be described as a repeating pattern of peaks 20*a* and valleys 20*b* across the width W of the webbing 12. For the sake of description, each upper warp yarn bundle 26 includes a pair of parallel trailing yarns 26*a* and a leading yarn 26*b* disposed between and parallel to the pair of trailing yarns 26*a*. Similarly, each lower warp yarn bundle 28 includes a pair of parallel trailing yarns 28*a* and a leading yarn 28*b* disposed between and parallel to the pair of trailing yarns 28*a*. While the plurality of warp yarns 22 is described as including upper and lower warp yarn bundles 26, 28, the reference to "upper" and "lower" is merely for the sake of description. That is, the yarns in each of the upper and lower warp yarn bundles 26, 28 extend both above and below the weft yarns 20 and, as such, depending on the particular location of the cross-section taken through the webbing 12, the upper warp yarn bundles 26 may be positioned above or below the weft yarns 20 and the lower warp yarn bundles 28 may be positioned above or below the weft yarns 20. As depicted, however, the upper warp yarn bundles 26 are always disposed opposite the weft yarns 20 from the lower warp yarn bundles 28, except at locations between weft yarns 20 where the individual yarns 26*a*, 26*b*, 28*a*, 28*b* of the warp yarn bundles 26, 28 may cross each other, as illustrated in FIG. 3, for example.

Figure 3A:
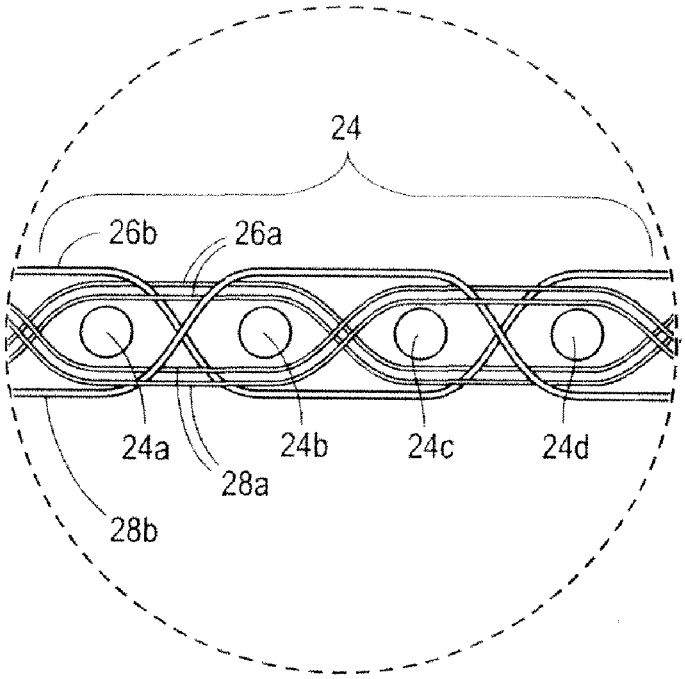
FIG. 3A is a detail view of the cross-section of FIG. 3, taken from circle 3A.

Referring now to FIG. 3A, the leading yarn 26*b* in each upper warp yarn bundle 26 of the disclosed webbing 12 extends above the first weft yarn 24*a*, between the first and second weft yarns 24*a*, 24*b*, below the second and third weft yarns 24*b*, 24*c*, between the third and fourth weft yarns 24*c*, 24*d*, and above the fourth weft yarn 24*d* of each weft yarn bundle 24. Moreover, the pair of trailing yarns 26*a* in each upper warp yarn bundle 26 extend above the first and second weft yarns 24*a*, 24*b*, between the second and third weft yarns 24*b*, 24*c*, and below the third and fourth weft yarns 24*c*, 24*d* of each weft yarn bundle 24 and then extend between the fourth weft yarn 24*d* and the first weft yarn 24*a* of the next weft yarn bundle 24. Furthermore, the leading yarn 28*b* in each lower warp yarn bundle 28 extends below the first weft yarn 24*a*, between the first and second weft yarns 24*a*, 24*b*, above the second and third weft yarns 24*b*, 24*c*, between the third and fourth weft yarns 24*c*, 24*d*, and below the fourth weft yarn 24*d* in each of the weft yarn bundles 24. Finally, the pair of trailing yarns 28*a* in each lower warp yarn bundle 28 extend below the first and second weft yarns 24*a*, 24*b*, between the second and third weft yarns 24*b*, 24*c*, and above the third and fourth weft yarns 24*c*, 24*d* of each weft yarn bundle 24 and then extend between the fourth weft yarn 24*d* and the first weft yarn 24*a* of the next weft yarn bundle 24. As shown in FIGS. 1, 2, and 3, the above-described weave pattern repeats itself along the length L of the webbing 12 of the present example to define the woven product 10, having the surface texture described above and depicted in FIG. 1A.

To fabricate the webbing 12 described above with reference to FIGS. 1-3A, one method can include manipulating the plurality of weft yarns 20 relative to the plurality of warp yarns 22, which can be held taught by a loom, for example. In one fabrication method, with reference to FIG. 3A, the first weft yarn 24*a* of each weft yarn bundle 24 is woven (i) below the leading yarn 26*b* of each upper warp yarn bundle 26, (ii) below the pair of trailing yarns 26*a* of each upper warp yarn bundle 26, (iii) above the leading yarn 28*b* of each lower warp yarn bundle 28, and (iv) above the pair of trailing yarns 28*a* of each lower warp yarn bundle 28. Additionally, the second weft yarn 24*b* of each weft yarn bundle 24 is woven (i) below the leading yarn 28*b* of each lower warp yarn bundle 28, (ii) below the pair of trailing yarns 26*a* of each upper warp yarn bundle 26, (iii) above the leading yarn 26*b* of each upper warp yarn bundle 26, and (iv) above the pair of trailing yarns 28*a* of each lower warp yarn bundle 28. Furthermore, the third weft yarn 24*c* of each weft yarn bundle 24 is woven (i) below the leading yarn 28*b* of each lower warp yarn bundle 28, (ii) below the pair of trailing yarns 28*a* of each lower warp yarn bundle 28, (iii) above the leading yarn 26*b* of each upper warp yarn bundle 26, and (iv) above the pair of trailing yarns 26*a* of each upper warp yarn bundle 26. Finally, the fourth weft yarn 24*d* of each weft yarn bundle is woven (i) below the leading yarn 26*b* of each upper warp yarn bundle 26, (ii) below the pair of trailing yarns 28*a* of each lower warp yarn bundle 28, (iii) above the leading yarn 28*b* of each lower warp yarn bundle 28, and (iv) above the pair of trailing yarns 26*a* of each upper warp yarn bundle 26.

The webbing 12 that results from the foregoing fabrication method, and which is depicted in FIGS. 1-3A, can be characterized by the pattern and harness diagram depicted in FIG. 4. The various reference numerals positioned throughout the diagram represent the harness numbers of the loom. For clarity, FIG. 4 only depicts a portion of the width W of the webbing 12 and, particularly, only for a single upper warp yarn bundle 26 and an immediately adjacent lower warp yarn bundle 28. Row 1 corresponds to what are described above as the trailing yarns 28*a* of the lower warp yarn bundles 28. Reference numeral 1 in FIG. 4 represents Harness #1. Row 2 corresponds to what is described above as the leading yarn 28*b* of the lower warp yarn bundles 28. Reference numeral 2 represents Harness #2. Row 3 corresponds to what are described above as the trailing yarns 26*a* of the upper warp yarn bundles 26. Reference numeral 3 represents Harness #3. Row 4 corresponds to what is described above as the leading yarn 26*b* of the upper warp yarn bundles 26. Reference numeral 4 represents Harness #4. Accordingly, it can be said that the woven webbing 12 of the example disclosed with reference to FIGS. 1-3A includes a 1-2-1-3-4-3 weave pattern.

The foregoing fabrication method can be performed with a conventional loom such as a needle loom, a shuttle loom, a wooden loom, or generally any other loom or other known process. For example, the webbing 12 may be fabricated by programming the chains or cams of a conventional needle loom according to the chain draft diagram depicted in FIG. 5, wherein the chains or cams are shown as columns on the horizontal axis and the chain rows are shown as rows on the vertical axis. FIG. 5 depicts only a portion of the width W of the webbing 12. An "X" in FIG. 5 indicates an up pick, while a "•" indicates a down pick. As such, in FIG. 5, the chain draft includes first through fourth rows and first through eighth columns. The first row includes down picks in the first, second, fifth, and sixth columns, and up picks in the third, fourth, seventh, and eighth columns. The second row includes down picks in the first, fourth, fifth, and eighth columns, and up picks in the second, third, sixth, and seventh columns. The third row includes down picks in the third, fourth, seventh, and eighth columns, and up picks in the first, second, fifth, and sixth columns. The fourth row includes down picks in the second, third, sixth, and seventh columns, and up picks in the first, fourth, fifth, and eighth columns.

Turning now to FIGS. 6-9, another example of a woven product 100 constructed in accordance with the teachings of the present disclosure, and method of fabricating the woven product 100, will be described. Similar to the product 10 described above with reference to FIGS. 1-4, the product 100 depicted in FIGS. 6-8 includes a width W, a length L, a top surface 112*a*, and a bottom surface 112*b*. The top and bottom surfaces 112*a*, 112*b* of the product 100 are textured to include interleaved rows of spaced apart buttons in a manner generally identical to that described above with reference to FIGS. 1 and 1A. Accordingly, a detailed description of the top and bottom surface textures will not be repeated.

Figure 6:
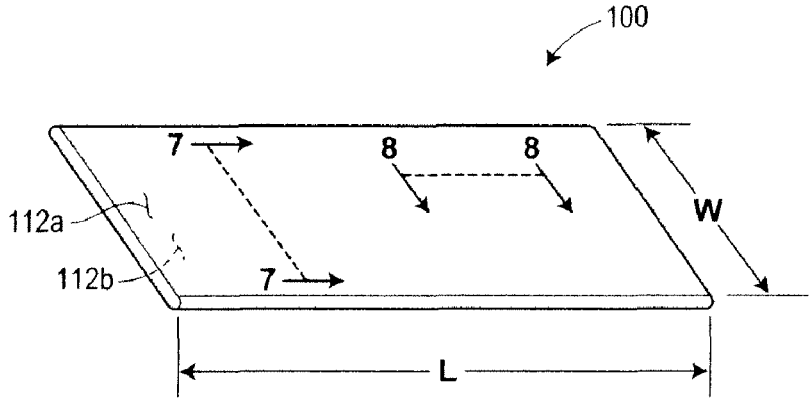
FIG. 6 is a perspective view of another example of a product constructed in accordance with the principles of the present disclosure.
Figure 7:
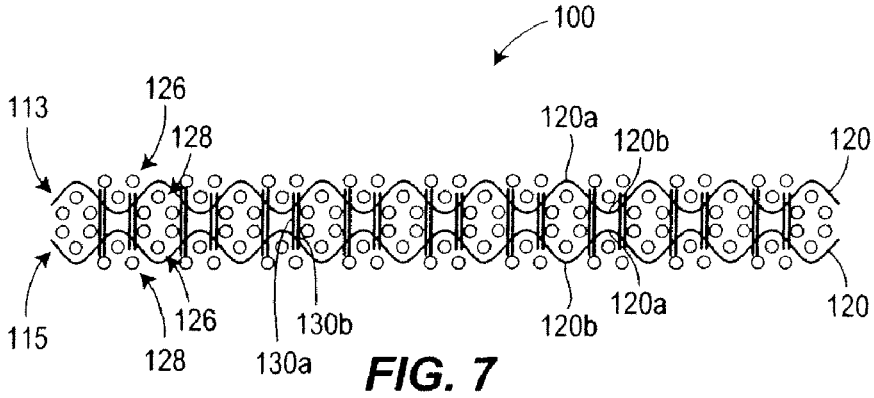
FIG. 7 is a cross-section of the product in FIG. 6, taken from line 7-7.
Figure 8:
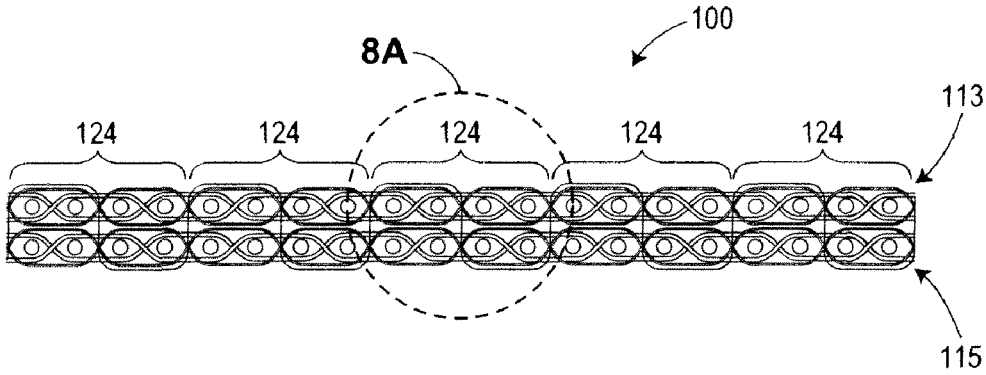
FIG. 8 is a cross-section of the product of FIG. 6, taken from line 8-8.

With reference to FIGS. 7 and 8, a distinction between the product 100 of the present example and the example described above with reference to FIGS. 1-4 is that the product 10 described above includes a single webbing 12, while the product 100 includes a first webbing 113 and a second webbing 115 disposed generally parallel to each other. Said another way, the product 100 of FIGS. 5-7 includes a plurality of pieces of stacked webbing. Additionally, as illustrated in FIG. 7, the product 100 includes a plurality of first and second alternating binder yarns 130*a*, 130*b* connecting the first and second webbings 113, 115 together. That is, the binder yarns 130*a*, 130*b* are disposed parallel to each other and spaced across the width W of the product 100 and woven into the first and second webbings 113, 115 to secure them together.

Each of the first and second webbings 113, 115 are constructed in a manner identical to the webbing 12 described above. That is, each of the first and second webbings 113, 115 includes a plurality of weft yarns 120 arranged, for the sake of description, in a plurality of weft yarn bundles 124 and interwoven with a plurality of warp yarns 122 arranged, for the sake of description, in a plurality of upper and lower warp yarn bundles 126, 128. Each warp yarn bundle 126, 128, as described above with reference to the product 10 depicted in FIGS. 1-3, includes a pair of trailing yarns 126*a*, 128*a* and a leading yarn 126*b*, 128*b* disposed between the trailing yarns 126*a*, 128*a*, as shown in FIG. 8A.

Referring back to FIG. 7, however, the weave patterns of the first and second webbings 113, 115 are laterally offset relative to each other along the width W of the product 100. That is, for the sake of description, in FIG. 7, lower warp yarn bundles 128 of the first webbing 113 are disposed in alignment with upper warp yarn bundles 126 of the second webbing 115 along the width W of the product 100 such that peaks 120*a* of weft yarns 120 of the second webbing 115 are disposed in alignment with valleys 120*b* of weft yarns 120 of the first webbing 113 along the width W of the product 100. In an alternative version of FIGS. 6-9, the weave patterns of the first and second webbings 113, 115 can be aligned. That is, the upper and lower warp yarn bundles 126, 128 of the first webbing 113 can be disposed in alignment with upper and lower warp yarn bundles 126, 128, respectively, of the second webbing 115, and the peaks 120*a* and valleys 120*b* of the weft yarns 120 of the first webbing 113 can be disposed in alignment with the peaks 120*a* and valleys 120*b*, respectively, of the weft yarns 120 of the second webbing 115.

To fabricate the product 100 described above with reference to FIGS. 6-9, one method can include fabricating each of the first and second webbings 113, 115 and securing them together with the binder yarns 130. The first and second webbings 113, 115 can be fabricated by manipulating a first plurality of weft yarns 120 relative to a first plurality of warp yarns 122 to fabricate the first webbing 113 in a manner generally similar to the fabrication of the webbing 12 described above with reference to FIGS. 1-4, and manipulating a second plurality of weft yarns 120 relative to a second plurality of warp yarns 122 to fabricate the second webbing 115 in a manner identical to the fabrication of the webbing 12 described above with reference to FIGS. 1-4. Accordingly, the specific construct and methods of fabricating the first and second webbings 113, 115 will not be reiterated. Furthermore, as mentioned, the method of fabricating includes weaving the plurality of binder yarns 130 between the pluralities of weft yarns 120 of the first and second webbings 113, 115 to secure the first and second webbings 113, 115 together.

Figures 8A, 9, 10:
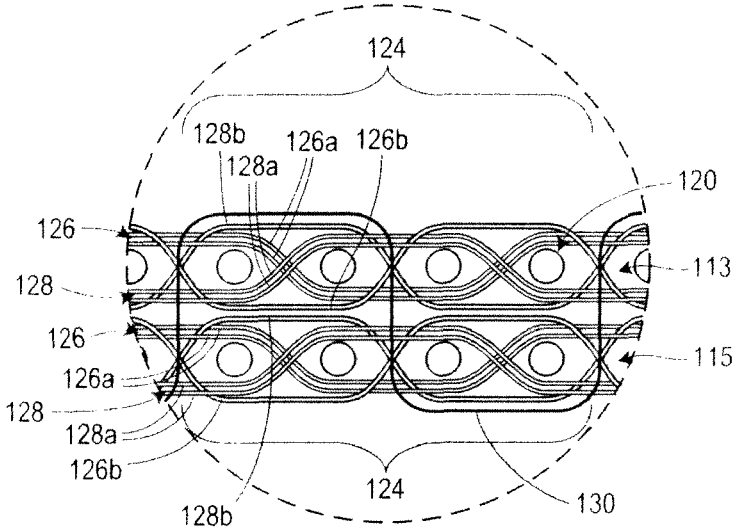
FIG. 8A is a detail view of the cross-section of FIG. 8, taken from circle 8A.
FIG. 9 is a pattern and harness diagram representative of the woven product of FIGS. 6-8A.
FIG. 10 is a chain draft diagram for fabricating the woven product of FIGS. 6-8A.

The product 100 that is depicted in FIGS. 6-8A can be characterized by the pattern and harness diagram depicted in FIG. 9. The various reference numerals positioned throughout the diagram represent the harness numbers of the loom. For clarity, FIG. 9 is only for a portion of the width W of the product 100. Row 1 corresponds to what are described above as the trailing yarns 126*a* of the lower warp yarn bundles 128 of the first webbing 113, and the first binder yarns 130*a*. Reference numeral 1 represents Harness #1, and reference numeral 9 represents Harness #9. Row 2 corresponds to what is described above as the leading yarn 128*b* of the lower warp yarn bundles 128 of the first webbing 113, and the first binder yarns 130*a*. Reference numeral 2 represents Harness #2, and reference numeral 9 represents Harness #9. Row 3 corresponds to what are described above as the trailing yarns 126*a* of the upper warp yarn bundles 28 of the first webbing 113, and the second binder yarns 130*b*. Reference numeral 3 represents Harness #3, and reference numeral 10 represents Harness #10. Row 4 corresponds to what is described above as the leading yarn 126*b* of the upper warp yarn bundles 126 of the first webbing 113, and the second binder yarns 130*b*. Reference numeral 4 represents Harness #4, and reference numeral 10 represents Harness #10. Row 5 corresponds to what are described above as the trailing yarns 126*a* of the upper warp yarn bundles 126 of the second webbing 115, and the first binder yarns 130*a*. Reference numeral 5 represents Harness #5, and reference numeral 9 represents Harness #9. Row 6 corresponds to what is described above as the leading yarn 126*b* of the upper warp yarn bundles 126 of the second webbing 115, and the first binder yarns 130*a*. Reference numeral 6 represents Harness #6, and reference numeral 9 represents Harness #9. Row 7 corresponds to what are described above as the trailing yarns 128*a* of the lower warp yarn bundles 128 of the second webbing 115, and the second binder yarns 130*b*. Reference numeral 7 represents Harness #7, and reference numeral 10 represents Harness #10. Row 8 corresponds to what is described above as the leading yarn 128*b* of the lower warp yarn bundles 128 of the second webbing 115, and the second binder yarns 130*b*. Reference numeral 8, and reference numeral 10 represents Harness #10. Accordingly, it can be said that the woven product 100 of the example disclosed with reference to FIGS. 6-8A includes a 1-2-1-9-9-3-4-3-10-10-5-6-5-9-9-7-8-7-10-10 weave pattern.

The foregoing product 100 can be fabricated with a conventional loom such as a needle loom, a shuttle loom, a wooden loom, or generally any other loom or other known process. For example, the product 100 may be fabricated by programming the chains or cams of a conventional needle loom according to the chain draft diagram depicted in FIG. 10, wherein the chains or cams are shown as columns on the horizontal axis and the chain rows are shown as rows on the vertical axis. FIG. 10 depicts only a portion of the width W of the product 100. An "X" in FIG. 10 indicates an up pick, while a "•" indicates a down pick. As such, in FIG. 10, the chain draft includes first through eighth rows and first through tenth columns. The first row includes down picks in the first, third, and fifth through ninth columns, and up pick in the second, fourth, and tenth columns. The second row includes down picks in the first through fourth, sixth, eighth, and ninth columns, and up picks in the fifth, seventh, and tenth columns. The third row includes down picks in the first, third through seventh, and tenth columns, and up picks in the second, eighth, and ninth columns. The fourth row includes down picks in the first, second, fourth, sixth through eighth, and tenth columns, and up picks in the third, fifth, and ninth columns. The fifth row includes down picks in the first through fifth, seventh, and ninth columns, and up picks in the sixth, eighth, and tenth columns. The sixth row includes down picks in the second, and fourth through ninth columns, and up picks in the first, third, and tenth columns. The seventh row includes adown picks in the first through third, fifth, seventh, and eighth columns, and up picks in the fourth, sixth, and ninth columns. Finally, the eighth row includes down picks in the second through sixth, eighth, and tenth columns, and up picks in the first, seventh, and ninth columns.

Figure 11:
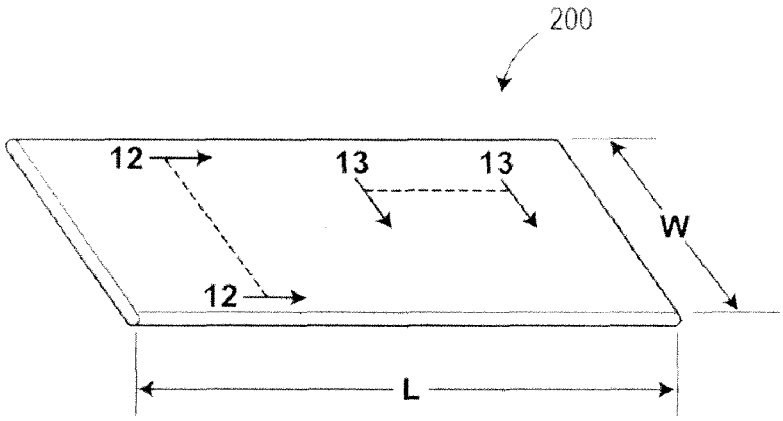
FIG. 11 is a perspective view of another example of a product constructed in accordance with the principles of the present disclosure.
Figure 12:
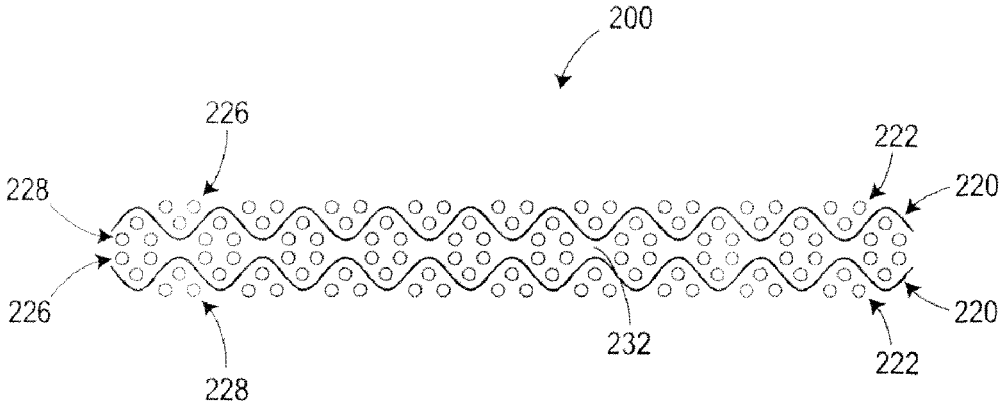
FIG. 12 is a cross-section of the product in FIG. 11, taken from line 12-12.
Figure 13:
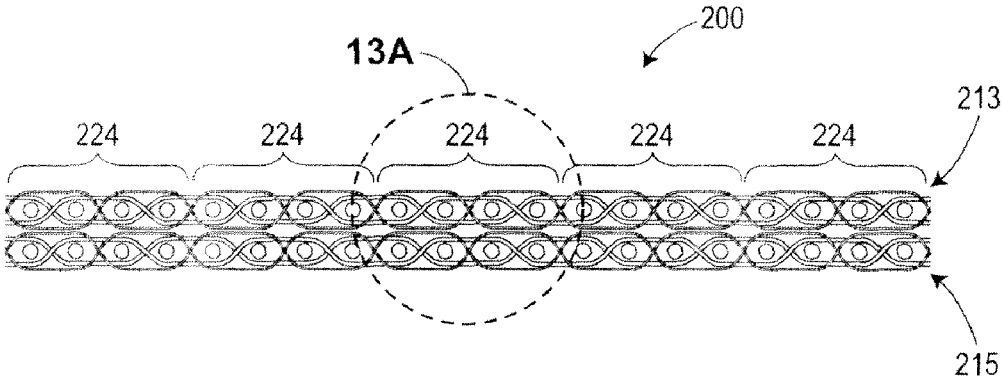
FIG. 13 is a cross-section of the product of FIG. 11, taken from line 13-13.
Figure 13A:
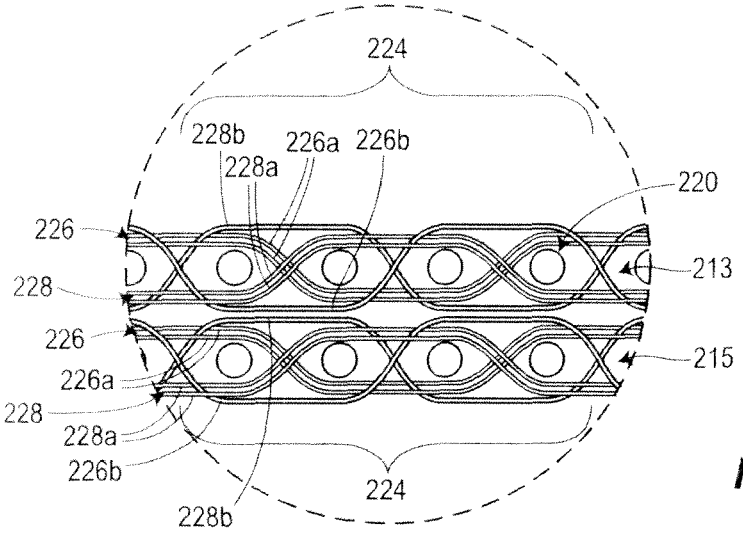

While the product 100 of FIGS. 6-8 includes first and second binder yarns 130*a*, 130*b* spaced across the width W of the product 100, another version of the product 100 depicted in FIGS. 6-8 could be constructed without binder yarns 130*a*, 13*b*. FIGS. 11-13A depict one such product 200. The construction of the product 200 in FIGS. 11-13 is identical to that in FIGS. 6-8, except it does not include binder yarns 130*a*, 130*b*. That is, the product 200 includes first and second webbings 213, 215, each having a plurality of weft yarns 220 arranged, for the sake of description, in a plurality of weft yarn bundles 224 and interwoven with a plurality of warp yarns 222 arranged, for the sake of description, in a plurality of upper and lower warp yarn bundles 226, 228. Each warp yarn bundle 226, 228, as described above with reference to the product 10 depicted in FIGS. 1-3, includes a pair of trailing yarns 226*a*, 228*a* and a leading yarn 226*b*, 228*b* disposed between the trailing yarns 226*a*, 228*a*, as shown in FIG. 13A. As mentioned, the product 200 does not include binder yarns 130*a*, 130*b*. So configured, the product 200 includes first and second webbings 213, 215 defining a pocket 232 disposed therebetween. The pocket 232 extends along the length L of the product 200 and could receive a stuffier yarn or some other material, or could remain empty.

Figure 14:
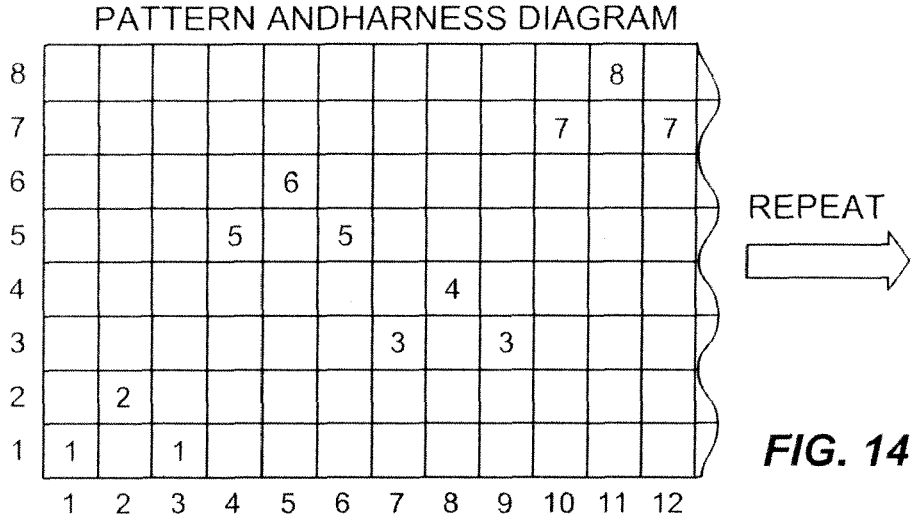
FIG. 14 is a pattern and harness diagram representative of the woven product of FIGS. 11-13A.

The product 100 that is depicted in FIGS. 11-13A can be characterized by the pattern and harness diagram depicted in FIG. 14. The various reference numerals positioned throughout the diagram represent the harness numbers of the loom. For clarity, FIG. 14 depicts only a portion of the width W of the product 200. Row 1 corresponds to what are described above as the trailing yarns 126*a* of the lower warp yarn bundles 128 of the first webbing 113. Reference numeral 1 represents Harness #1. Row 2 corresponds to what is described above as the leading yarn 228*b* of the lower warp yarn bundles 228 of the first webbing 213. Reference numeral 2 represents Harness #2. Row 3 corresponds to what are described above as the trailing yarns 226*a* of the upper warp yarn bundles 228 of the first webbing 213. Reference numeral 3 represents Harness #3. Row 4 corresponds to what is described above as the leading yarn 226*b* of the upper warp yarn bundles 226 of the first webbing 213. Reference numeral 4 represents Harness #4. Row 5 corresponds to what are described above as the trailing yarns 226*a* of the upper warp yarn bundles 226 of the second webbing 215. Reference numeral 5 represents Harness #5. Row 6 corresponds to what is described above as the leading yarn 226*b* of the upper warp yarn bundles 226 of the second webbing 215. Reference numeral 6 represents Harness #6. Row 7 corresponds to what are described above as the trailing yarns 228*a* of the lower warp yarn bundles 228 of the second webbing 215. Reference numeral 7 represents Harness #7. Row 8 corresponds to what is described above as the leading yarn 228*b* of the lower warp yarn bundles 228 of the second webbing 215. Reference numeral 8 represents Harness #8. Accordingly, based on the foregoing, it can be said that the woven product 200 of the example disclosed with reference to FIGS. 11-13 includes a 1-2-1-3-4-3-5-6-5-7-8-7 weave pattern.

Figure 15:
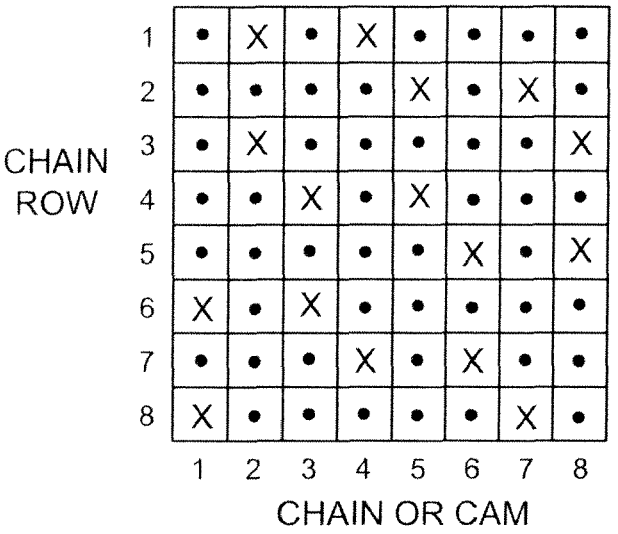
FIG. 15 is a chain draft diagram for fabricating the woven product of FIGS. 11-13A.

The foregoing product 200 can be fabricated with a conventional loom such as a needle loom, a shuttle loom, a wooden loom, or generally any other loom or other known process. For example, the product 200 may be fabricated by programming the chains or cams of a conventional needle loom according to the chain draft diagram depicted in FIG. 15, wherein the chains or cams are shown as columns on the horizontal axis and the chain rows are shown as rows on the vertical axis. FIG. 15 depicts only a portion of the width W of the product 100. An "X" in FIG. 10 indicates an up pick, while a "•" indicates a down pick. As such, the chain draft diagram of FIG. 15 includes first through eighth rows and first through eighth columns. In the depicted example, the first row includes down picks in the first, third, and fifth through eighth columns, and up pick in the second and fourth columns. The second row includes down picks in the first through fourth, sixth, and eighth columns, and up picks in the fifth and seventh columns. The third row includes down picks in the first and third through seventh columns, and up picks in the second and eighth columns. The fourth row includes down picks in the first, second, fourth, and sixth through eighth columns, and up picks in the third and fifth columns. The fifth row includes down picks in the first through fifth and seventh columns, and up picks in the sixth and eighth columns. The sixth row includes down picks in the second, and fourth through eighth columns, and up picks in the first and third columns. The seventh row includes down picks in the first through third, fifth, seventh, and eighth columns, and up picks in the fourth and sixth columns. Finally, the eighth row includes down picks in the second through sixth and eighth columns, and up picks in the first and seventh columns.

While the products 100, 200 described above include first and second webbings, yet other forms of these embodiments may include more than two webbings with or without binder yarns, for example.

As mentioned above, the various products 10, 100, 200 described herein are more resistant to abrasion than conventional products. This increased abrasion resistance also allows the products 10, 100, 200 to exhibit improved tensile strength retention after abrasion when compared to comparable conventional webbing products including, for example, the conventional 1-2-3-4-3-2-1 webbing product described above. Depending on the specific parameters of the webbing products compared, the improvement in tensile strength retention can be anywhere in a range of approximately 1% to approximately 1000%. Comparable webbing products include webbing products constructed according to similar parameters including width, weight, thickness, initial tensile strength, yarn material, etc. Standard abrasion tests include the ASTM D6770-07 test and the FMVSS 209 test, each of which can be characterized as hex bar tests.

Figure 16:
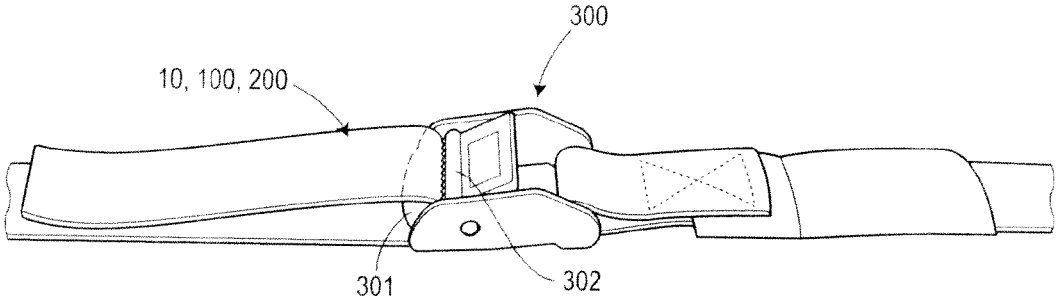
FIG. 16 is a perspective view of a product constructed in accordance with the principles of the present disclosure used in combination with a buckle.

Therefore, the products 10, 100, 200 disclosed herein have increased utility and longevity over prior art products when used, for example, in combination with a buckle 300, as shown in FIG. 16, of a harness, a back pack, a tie down, a tow strap, a mountaineering device, or any other device that would benefit from being used in conjunction with a webbing product that exhibits increased abrasion resistance. For example, as illustrated in FIG. 16, a strap or section of the product 10, 100, 200 manufactured as described above, may wind through the buckle 300 such that one or more bar members 301 and knurled locking members 302 of the buckle 300 come into contact with the product 10, 100, 200 (e.g., across the width W thereof) during tightening or loosening of the buckle 300. The product 10, 100, 200 may additionally be wound around a bar member 301 (shown in phantom relief in FIG. 16) during operation of the buckle 300. As will be understood, the bar member 301 and the locking member 302 come into contact with and may abraid one or both top and bottom surfaces of the product 10, 100, 200 during use.

While the foregoing provides various woven products and methods of fabricating woven products, these are merely exemplary, and the present invention is not intended to be limited to the specific examples disclosed. Rather, the present invention is intended to be defined by the spirit and scope of the appending claims and all equivalents thereof.

What is claimed:

1. A woven product, comprising:

a first plurality of parallel weft yarns; and a first plurality of warp yarns interwoven perpendicular to the first plurality of weft yarns to define a first webbing with opposite top and bottom surfaces, each of the top and bottom surfaces comprising a plurality of rows of buttons spaced apart by a plurality of depressions, the plurality of buttons of each row interleaved with a plurality of buttons of an adjacent row.

2. The woven product of claim 1, wherein each button comprises a pair of adjacent trailing petals and a leading petal disposed between and extending outward from the trailing petals.

3. The woven product of claim 1, wherein the first plurality of weft yarns comprises a plurality of weft yarn bundles, each weft yarn bundle comprising first, second, third, and fourth parallel and adjacent weft yarns; and the first plurality of warp yarns comprises a plurality of upper warp yarn bundles and a plurality of lower warp yarn bundles disposed perpendicular to and interwoven with the plurality of weft yarn bundles, each warp yarn bundle comprising a pair of parallel trailing yarns and a leading yarn disposed between and parallel to the pair of trailing yarns, the leading yarn in each upper warp yarn bundle extending above the first and fourth weft yarns and below the second and third weft yarns in each weft yarn bundle, the pair of trailing yarns in each upper warp yarn bundle extending above the first and second weft yarns and below the third and fourth weft yarns of each weft yarn bundle, the leading yarn in each lower warp yarn bundle extending below the first and fourth weft yarns and above the second and third weft yarns in each weft yarn bundle, the pair of trailing yarns in each lower warp yarn bundle extending below the first and second weft yarns and above the third and fourth weft yarns of each weft yarn bundle.

4. The woven product of claim 1, further comprising:

a second plurality of parallel weft yarns disposed below the first plurality of weft yarns; and a second plurality of warp yarns interwoven perpendicular to the second plurality of weft yarns to define a second webbing disposed below and parallel to the first webbing, the second webbing having opposite top and bottom surfaces, each of the top and bottom surfaces comprising a plurality of rows of yarn buttons, each row comprising a plurality of buttons spaced apart by a plurality of depressions, the plurality of buttons of each row interleaved with a plurality of buttons of an adjacent row.

5. The woven product of claim 4, further comprising a plurality of binder yarns disposed parallel to each other and perpendicular to the first and second pluralities of weft yarns, the binder yarns woven into the first and second webbings and securing the first and second pluralities of weft yarns together.

6. The woven product of claim 4, wherein a central section of the first and second webbings are not secured together, thereby defining at least one pocket extending along a length of the product.

7. A woven product, comprising:

a first plurality of weft yarns and a first plurality of warp yarns interwoven with the first plurality of weft yarns to define a first webbing, the first plurality of weft yarns comprising a plurality of weft yarn bundles, each weft yarn bundle comprising first, second, third, and fourth parallel and adjacent weft yarns, the first plurality of warp yarns comprising a plurality of upper warp yarn bundles and a plurality of lower warp yarn bundles disposed perpendicular to and interwoven with the plurality of weft yarn bundles, each warp yarn bundle comprising a pair of parallel trailing yarns and a leading yarn disposed between and parallel to the pair of trailing yarns, the leading yarn in each upper warp yarn bundle extending above the first and fourth weft yarns and below the second and third weft yarns in each weft yarn bundle, the pair of trailing yarns in each upper warp yarn bundle extending above the first and second weft yarns and below the third and fourth weft yarns of each weft yarn bundle, the leading yarn in each lower warp yarn bundle extending below the first and fourth weft yarns and above the second and third weft yarns in each weft yarn bundle, the pair of trailing yarns in each lower warp yarn bundle extending below the first and second weft yarns and above the third and fourth weft yarns of each weft yarn bundle.

8. The woven product of claim 7, wherein the first webbing includes opposite top and bottom surfaces, each of the top and bottom surfaces comprising a plurality of rows of buttons spaced apart by a plurality of depressions, the plurality of buttons of each row interleaved with a plurality of buttons of an adjacent row.

9. The woven product of claim 8, wherein each button comprises a pair of adjacent trailing petals and a leading petal disposed between and extending outward from the trailing petals.

10. The woven product of claim 7, further comprising:

a second plurality of weft yarns and a second plurality of warp yarns interwoven with the second plurality of weft yarns to define a second webbing disposed parallel to the first webbing, the second plurality of weft yarns comprising a plurality of weft yarn bundles, each weft yarn bundle comprising first, second, third, and fourth parallel and adjacent weft yarns, the second plurality of warp yarns comprising a plurality of upper warp yarn bundles and a plurality of lower warp yarn bundles disposed perpendicular to and interwoven with the plurality of weft yarn bundles, each warp yarn bundle comprising a pair of parallel trailing yarns and a leading yarn disposed between and parallel to the pair of trailing yarns, the leading yarn in each upper warp yarn bundle extending above the first and fourth weft yarns and below the second and third weft yarns in each weft yarn bundle, the pair of trailing yarns in each upper warp yarn bundle extending above the first and second weft yarns and below the third and fourth weft yarns of each weft yarn bundle, the leading yarn in each lower warp yarn bundle extending below the first and fourth weft yarns and above the second and third weft yarns in each weft yarn bundle, the pair of trailing yarns in each lower warp yarn bundle extending below the first and second weft yarns and above the third and fourth weft yarns of each weft yarn bundle.

11. The woven product of claim 10, wherein the first webbing and the second webbing each includes opposite top and bottom surfaces, each of the top and bottom surfaces comprising a plurality of rows of buttons spaced apart by a plurality of depressions, the plurality of buttons of each row interleaved with a plurality of buttons of an adjacent row.

12. The woven product of claim 10, further comprising a plurality of binder yarns disposed parallel to each other and perpendicular to the first and second pluralities of weft yarns, the binder yarns woven into the first and second webbings and securing the first and second pluralities of weft yarns together.

13. The woven product of claim 10, further comprising at least one pocket extending along a length of the product between the first and second webbings.

14. A method of weaving a product including a first plurality of weft yarns and a first plurality of warp yarns interwoven with the first plurality of weft yarns to define a first webbing, the first plurality of weft yarns including a plurality of weft yarn bundles, wherein each weft yarn bundle includes first, second, third, and fourth parallel weft yarns, the first plurality of warp yarns including a plurality of upper and lower warp yarn bundles, each warp yarn bundle including a pair of trailing yarns and a leading yarn disposed between the trailing yarns, the method comprising:

manipulating the first plurality of weft yarns relative to the first plurality of warp yarns to define the first webbing, wherein manipulating the first plurality of weft yarns includes:

weaving the first weft yarn of each weft yarn bundle (i) below the leading yarn of each upper warp yarn bundle, (ii) below the pair of trailing yarns of each upper warp yarn bundle, (iii) above the leading yarn of each lower warp yarn bundle, and (iv) above the pair of trailing yarns of each lower warp yarn bundle;

weaving the second weft yarn of each weft yarn bundle (i) below the leading yarn of each lower warp yarn bundle, (ii) below the pair of trailing yarns of each upper warp yarn bundle, (iii) above the leading yarn of each upper warp yarn bundle, and (iv) above the pair of trailing yarns of each lower warp yarn bundle;

weaving the third weft yarn of each weft yarn bundle (i) below the leading yarn of each lower warp yarn bundle, (ii) below the pair of trailing yarns of each lower warp yarn bundle, (iii) above the leading yarn of each upper warp yarn bundle, and (iv) above the pair of trailing yarns of each upper warp yarn bundle; and weaving the fourth weft yarn of each weft yarn bundle (i) below the leading yarn of each upper warp yarn bundle, (ii) below the pair of trailing yarns of each lower warp yarn bundle, (iii) above the leading yarn of each lower warp yarn bundle, and (iv) above the pair of trailing yarns of each upper warp yarn bundle.

15. The method of claim 14, wherein the product further includes a second plurality of weft yarns and a second plurality of warp yarns interwoven with the second plurality of weft yarns to define a second webbing that is disposed parallel to the first webbing, the second plurality of weft yarns including a plurality of weft yarn bundles, wherein each weft yarn bundle includes first, second, third, and fourth parallel weft yarns, the second plurality of warp yarns including a plurality of upper and lower warp yarn bundles, each warp yarn bundle including a pair of trailing yarns and a leading yarn disposed between the trailing yarns, and wherein the method further comprises:

manipulating the second plurality of weft yarns perpendicular to the second plurality of warp yarns to define the second webbing, wherein manipulating the second plurality of weft yarns includes:

weaving the first weft yarn of each weft yarn bundle (i) below the leading yarn of each upper warp yarn bundle, (ii) below the pair of trailing yarns of each upper warp yarn bundle, (iii) above the leading yarn of each lower warp yarn bundle, and (iv) above the pair of trailing yarns of each lower warp yarn bundle;

weaving the second weft yarn of each weft yarn bundle (i) below the leading yarn of each lower warp yarn bundle, (ii) below the pair of trailing yarns of each upper warp yarn bundle, (iii) above the leading yarn of each upper warp yarn bundle, and (iv) above the pair of trailing yarns of each lower warp yarn bundle;

weaving the third weft yarn of each weft yarn bundle (i) below the leading yarn of each lower warp yarn bundle, (ii) below the pair of trailing yarns of each lower warp yarn bundle, (iii) above the leading yarn of each upper warp yarn bundle, and (iv) above the pair of trailing yarns of each upper warp yarn bundle; and weaving the fourth weft yarn of each weft yarn bundle (i) below the leading yarn of each upper warp yarn bundle, (ii) below the pair of trailing yarns of each lower warp yarn bundle, (iii) above the leading yarn of each lower warp yarn bundle, and (iv) above the pair of trailing yarns of each upper warp yarn bundle.

16. The method of claim 15, further comprising weaving a plurality of binder yarns between the first and second pluralities of weft yarns to secure the first and second webbings together.

17. A method of fabricating a woven product having a plurality of weft yarns interwoven with a plurality of warp yarns, the method comprising:

operating a loom having a plurality of harnesses and a plurality of chains or cams set up according to a chain draft diagram having first through fourth rows and first through eighth columns, the first row comprising down picks in the first, second, fifth, and sixth columns, and up picks in the third, fourth, seventh, and eighth columns, the second row comprising down picks in the first, fourth, fifth, and eighth columns, and up picks in the second, third, sixth, and seventh columns, the third row comprising down picks in the third, fourth, seventh, and eighth columns, and up picks in the first, second, fifth, and sixth columns, the fourth row comprising down picks in the second, third, sixth, and seventh columns, and up picks in the first, fourth, fifth, and eighth columns.

18. A method of fabricating a woven product having a plurality of weft yarns interwoven with a plurality of warp yarns, the method comprising:

operating a loom having a plurality of harnesses and a plurality of chains or cams set up according to a chain draft diagram having first through eighth rows and first through tenth columns, the first row comprising down picks in the first, third, and fifth through ninth columns, and up pick in the second, fourth, and tenth columns, the second row comprises down picks in the first through fourth, sixth, eighth, and ninth columns, and up picks in the fifth, seventh, and tenth columns, the third row comprises down picks in the first, third through seventh, and tenth columns, and up picks in the second, eighth, and ninth columns, the fourth row comprises down picks in the first, second, fourth, sixth through eighth, and tenth columns, and up picks in the third, fifth, and ninth columns, the fifth row comprises down picks in the first through fifth, seventh, and ninth columns, and up picks in the sixth, eighth, and tenth columns, the sixth row comprises down picks in the second, and fourth through ninth columns, and up picks in the first, third, and tenth columns, the seventh row comprises adown picks in the first through third, fifth, seventh, and eighth columns, and up picks in the fourth, sixth, and ninth columns, and the eighth row comprises down picks in the second through sixth, eighth, and tenth columns, and up picks in the first, seventh, and ninth columns.

19. A method of fabricating a woven product having a plurality of weft yarns interwoven with a plurality of warp yarns, the method comprising:

operating a loom having a plurality of harnesses and a plurality of chains or cams set up according to a chain draft diagram having first eighth fourth rows and first through eighth columns, the first row comprising down picks in the first, third, and fifth through eighth columns, and up pick in the second and fourth columns, the second row comprises down picks in the first through fourth, sixth, and eighth columns, and up picks in the fifth and seventh columns, the third row comprises down picks in the first and third through seventh columns, and up picks in the second and eighth columns, the fourth row comprises down picks in the first, second, fourth, and sixth through eighth columns, and up picks in the third and fifth columns, the fifth row comprises down picks in the first through fifth and seventh columns, and up picks in the sixth and eighth columns, the sixth row comprises down picks in the second, and fourth through eighth columns, and up picks in the first and third columns, the seventh row comprises down picks in the first through third, fifth, seventh, and eighth columns, and up picks in the fourth and sixth columns, and the eighth row comprises down picks in the second through sixth and eighth columns, and up picks in the first and seventh columns.

* * * * *

UNITED STATES PATENT AND TRADEMARK OFFICE

CERTIFICATE OF CORRECTION

PATENT NO. : 8,136,555 B1
APPLICATION NO. : 13/069822
DATED : March 20, 2012
INVENTOR(S) : Eun Seong Chang et al.

It is certified that error appears in the above-identified patent and that said Letters Patent is hereby corrected as shown below:

In the Claims

In Column 18, Line 10, in Claim 18, delete "adown" and insert -- down --, therefor.

Signed and Sealed this
Thirtieth Day of September, 2014

Michelle K. Lee

Michelle K. Lee
*Deputy Director of the United States Patent and Trademark Office*